United States Patent [19]

Pupp et al.

[11] Patent Number: 4,718,598

[45] Date of Patent: Jan. 12, 1988

[54] LIQUIDS PACKAGE WITH HANDLE

[75] Inventors: Herwig Pupp, Lund; Franz Soukup, Malmo, both of Sweden; Wilhelm Reil, Bensheim, Fed. Rep. of Germany

[73] Assignee: Tetra Pak Finance & Trading S.A., Pully, Switzerland

[21] Appl. No.: 36,953

[22] Filed: Apr. 10, 1987

[30] Foreign Application Priority Data

Apr. 17, 1986 [DE] Fed. Rep. of Germany ..... 3612895

[51] Int. Cl.[4] ..... B65D 5/46

[52] U.S. Cl. ..... 229/52 A; 229/DIG. 6; 229/111; 220/94 R; 222/210

[58] Field of Search ..... 229/52 A, 52 B, DIG. 6, 229/52 AL, 108–112, 164; 220/94 R, 96; 383/6, 10; 222/210

[56] References Cited

U.S. PATENT DOCUMENTS 875,409 12/1907 Brown ..... 229/111
2,483,464 10/1949 Johnson ..... 229/108
3,195,752 7/1965 Cox ..... 220/94 R

FOREIGN PATENT DOCUMENTS 2711632 9/1978 Fed. Rep. of Germany ... 229/DIG. 6

*Primary Examiner*—Willis Little
*Attorney, Agent, or Firm*—Biebel, French & Nauman

[57] ABSTRACT

The invention describes a liquids package includes a tube formed by a longitudinal sealing seam and a bottom. A cover, which consists of thermoplastics synthetic material with no carrier mateial, is molded onto the tube and comprises a pourer device. The tube consists of coated cardboard. The bottom is tetragonal and is constructed from the folded-over tube as a folded-over closure. A handle connected to the cover is mounted laterally on the tube and below the cover. To allow the end user ease of handling and so that the package can be space-savingly stored and transported, while ensuring that the package can be produced from a flat strip of cardboard, while forming a quadrilateral outer contour of the package, the outside dimensions of the bottom are equal to the tetragonal cross-sectional dimensions of the package from the bottom to the cover. The handle together with the cover is injection molded on within the quadrilateral outer contours of the package.

7 Claims, 8 Drawing Figures

Fig. 2
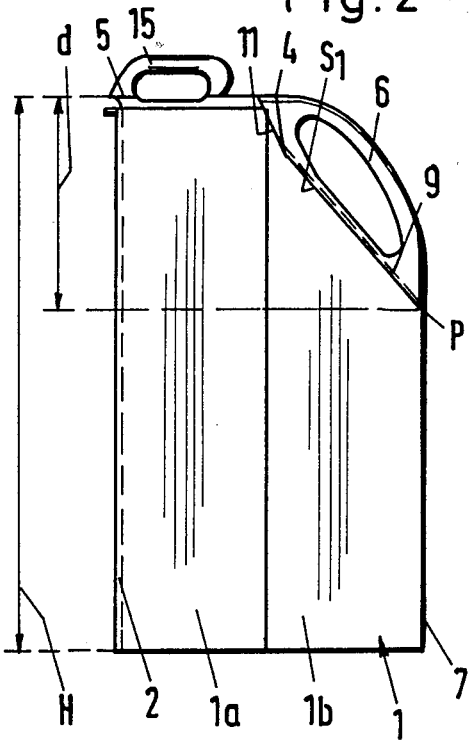
Fig. 3
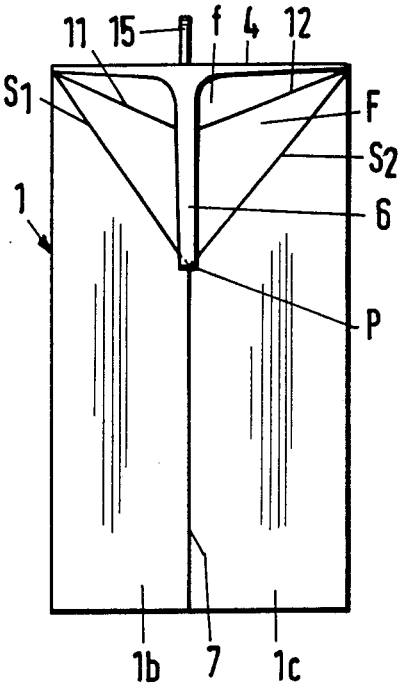
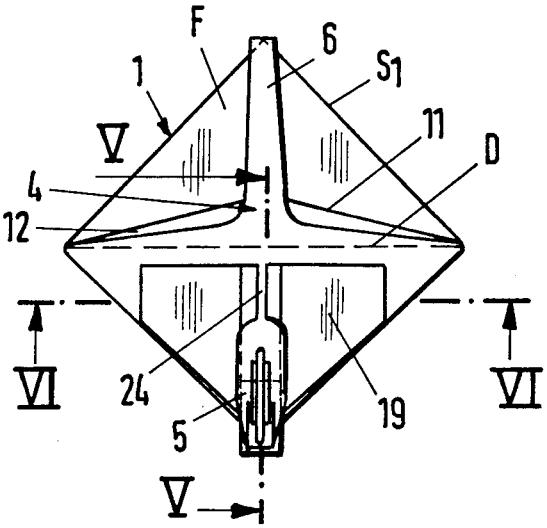
Fig. 4

LIQUIDS PACKAGE WITH HANDLE

BACKGROUND OF THE INVENTION

The invention relates to a package for flowable contents, having a tube formed by at least one longitudinal seam. At the ends of the tube are a bottom and cover. The cover consists of thermoplastics synthetic material with no carrier material, and is injection molded onto the tube and has a pourer device. The tube consists of carrier material, for instance cardboard, coated at least on one side with thermoplastics synthetic material. The bottom is tetragonal and is constructed from the folded over tube of the package as a folded-over closure. A handle connected to the cover is mounted laterally on the tube and below the cover.

Of the many packages for liquids, some are known which are shaped into a tube from a flat sheet of coated cardboard, are filled and provided with a bottom and cover. The smaller packages used for milk, fruit juices, wine and the like, for example, those which have a capacity of one liter, in most cases do not have a handle. There are, however, also endeavors to produce larger packages, for example, for carrying drinking water.

In the case of these larger parkages, it is expedient to provide the consumer with a handle fixed on the package so that handling, namely, carrying out and pouring out, can be more convenient.

Package manufacturers have applied various considerations to see how a handle, mounted on a package of the aforementioned type intended for flowable material, can be produced most competitively and favorably. One consideration resides in having a part of the tube walls adjacent the periphery of the cover folded onto itself to constitute the handle, being connected to form a double-walled surface in which the handle aperture is provided. Thought has also been given to the convenience of extending the molded-on cover beyond the top edge of the double-walled surface with the handle aperture in order to provide. a reinforcing web. The manufacturer could also produce such a package from a flat sheet, in which case the other advantages of known packages could also be retained, for example, easy opening of an otherwise tightly sealed pourer device, reclosure thereof, etc.

The doubled-walled surface with the gripping aperture could in accordance with the aforedescribed package be of such a triangular shape that its top edge forms a short leg while its outwardly folded edge which extends substantially in the longitudinal direction of the tube forms a long le, the hypotenuse being constitued by the two superimposed inwardly folded edges. This face could best be of triangular construction, each half of the doubled-walled face likewise being triangular. This provides ready facility for gripping and a good strong handle.

However, such a package would have the disadvantage that apart from a special and unavoidable shaping cut at the bottom and cover of the package, a folding process for the said triangular face would become necessary, representing a relatively large amount of dead space in the package as a whole. Such a package could only be stacked and stored by occupying relatively considerable space; transport would involve considerable dead space. However, the package manufacturer is aware that the costs of transporting and storing liquid packages play a substantial role that further consideration had to be given to the subject in order further to improve the aforedescribed package.

SUMMARY OF THE INVENTION

The object of the present invention, therefore, is to provide a package of the type described at the outset, which offers the end user ease of handling and which can be stored and transported in a space-saving manner, and with manufacture from a flat strip of cardboard being feasible.

According to the invention, this problem is resolved in that while forming a quadrilateral outer contour of the package, the outside dimensions of the bottom are equal to the tetragonal cross-sectional dimensions of the package from the bottom to the cover and in that the handle, together with the cover, is injection molded on within the quadrilateral outer contours of the package. If the package described at the outset is shaped in the manner outlined by these features, then the end user has an easily-handled package for liquids or flowable substances. This package is also economically and technically of great interest to the manufacturer and the distributor of such a package because it can be space-savingly transported and stored. If, furthermore, per se known injection molding techniques are used, then the entire package can be produced from a flat sheet of cardboard. For example, it would be possible to form from the flat sheet of cardboard tube which could be connected through a longitudinal seam and at one end a synthetic plastics injection molding machine could provide it with a cover and a handle; the tube could subsequently be filled and finally sealed completely by means of a folded-over closure.

By the injection molding of the cover into position, it is likewise possible to provide a per se known and expedient pourer device. Thus, the end user is offered a liquids package which has substantially attained all the desirable qualities.

Although mention has been made hereinabove of quadrilateral external contour to the package, this is intended to convey the idea of the general shape of a cuboid which may quite easily have rectangular side walls. If the base surfaces of a parallelepiped are rectangular, and if the parallelepiped is straight, then it is described as a cuboid.

In contrast to the package mentioned at the outset, which has double-walled triangular panels with a gripping aperture, the package according to the invention has such an imaginary doubled-walled triangular panel cut from the coated sheet of cardboard, for example, substantially where the gripping aperture of the handle starts on the package described at the outset. Furthermore, the folding over can occur differently in that in the bottom area and extending upwardly into the middle area, the package remains cuboid, only the upper zone having a tetrahedral or pyramidal area cut out or removed from the tube for provision of the molded-on handle. During stacking and for transport purposes, the package according to the invention can be packed face-to-face quite closely without the costly loss of dead space.

In a further advantageous development of the invention, the handle is disposed in a tetrahedral space of which one edge is formed by the diagonal across the cover. It is known that the tetrahedron is a triangular pyramid. Consequently, it has triangular tetrahedral faces and one edge of one face lies therefore (in the case of the preferred embodiment which has just been described) on the diagonal of the cover. This diagonal lies expediently between those of the two corners of the right-angled or qudratic cover on which the pourer device is not provided. In other words, a straight line extends from the middle of this diagonal to the pourer device or puurer tip of the cover at a right angle to the aforesaid diagonal. Viewed from above, the handle likewise extends at a right angle to this diagonal, though certainly from the pourer device towards the other side of the diagonal. The package is particularly easily manufactured in this way because the diagonal also provides for favorable folds.

Furthermore, it is according to the invention favorable for the tetrahedral face passing through the diagonal of the cover to cut the rear longitudinal edge of the tube at a bottom corner point which is at a distance from the cover of one-third to one-half the height of the package. In other words, the angle of inclination of the integrally molded handle to the cover or to the longitudinal central axis through the tube can be sought out and adjusted. It is thereby expedient for the handle to be disposed as closely as possible to the center of gravity of the package. This is achieved if the handle can be disposed more towards the center of the package. This has practical grounds for use by the end user. In fact, once the latter has opened the package, then when the package is lifted by the handle according to the invention, the package should be as vertical as possible so that the contents are not shaken out prematurely when pouring commences.

The measures according to the invention also provide the further advantage that a favorable fold arrangement can be envisioned, so that less paper or cardboard is consumed.

Furthermore, it is according to the invention expedient if, starting from the bottom corner point, a double-walled base strip of coated cardboard is provided which extends in the direction of the longitudinal central axis through to the tube and to the cover. By means of this, the handle can, over the entire height of the tetrahedral face, be anchored rigidly on the diagonal to the cardboard material in the region of this tetrahedral face. Even in the case of relatively large liquids packages, the handle can no longer become detached during normal use of the package. All the forces initiated into the handle by the weight of the filled package are evenly distributed.

According to the invention, it has furthermore been found to be favorable for the doubled-walled base strip to be shorter than the height of the triangular tetrahedral face in respect of the diagonal, only a part of the tetrahedral face consisting of coated cardboard. From the upper end of the double-walled base strip, on the cover side, and as far as the diagonal, and laterally of this line as far as the ends of the diagonal, a triangular surface results which sould preferably consist of synthetic plastics material, being particularly advantageously injection molded onto the cardboard material together with the handle and the cover. An advantage which is achieved in consequence lies in avoiding the shaping cut already described hereinabove. In fact, if a package of the type described at the outset were to be shaped from one prepared blank with the double-laid triangular gripping area with the gripping aperture already formed therein, then when manufacturing the prepared blank, a man skilled in the art would immediately establish that at top and bottom ends, the cutting lines for the cardboard material for the package ought to be shape-cut. Otherwise, after the shaping, folding and sealing, there would be no guarantee of the cover and/or the bottom having a flat surface. According to the invention, these complicated cutting arrangements can be avoided by simple means.

According to the invention, it is also advantageous to provide a lifting handle in the region of the lower cornerpoint. Its attachment permits a location for the main handle so that prior to the first time the contents are poured out, the package is disposed substantially in the vertical to avoid the contents slurping out. Nevertheless, by using only a single hand, the end user can tip this package out of the vertical with the minimum effort because, for example, a single finger of the hand can be inserted into the handle and is sufficient to generate the horizontal component. By reason of this lifting handle, pouring is particularly convenient and simple.

Furthermore, it is according to the invention expedient if the top edge of the handle is fixed to the cover to extend in a rounded form from the rear longitudinal edge of the tube upwardly to the cover and forwardly to the pourer device, merging at least into a part of the surface of the cover. These measures permit an elegant line and the provision of an appealing appearance to the package, all the technical advantages being fully retained at the same time. It will be appreciated that the handle can be reinforced in per se known manner, by being, for example, given a profiled section in the form of transverse or longitudinal ribs or even ribs which extend radially outwardly from the handle aperture. The rounded outer surface of the handle can, furthermore, also take the form of a reinforcing edge.

Further advantages, features and possible applications of the present invention will become evident from the ensuing description in conjunction with the drawings which show various preferred embodiments.

BRIEF DESCRIPTION OF THE DRAWINGS

FIG. 2 is a side view of the package, viewed from the bottom left in FIG. 1;

FIG. 3 is a rear view of the package, in the direction of the pourer device and from the handle;

FIG. 4 is a plan view of the package, mainly onto the cover;

DETAILED DESCRIPTION OF PREFERRED EMBODIMENTS

Figure 8:
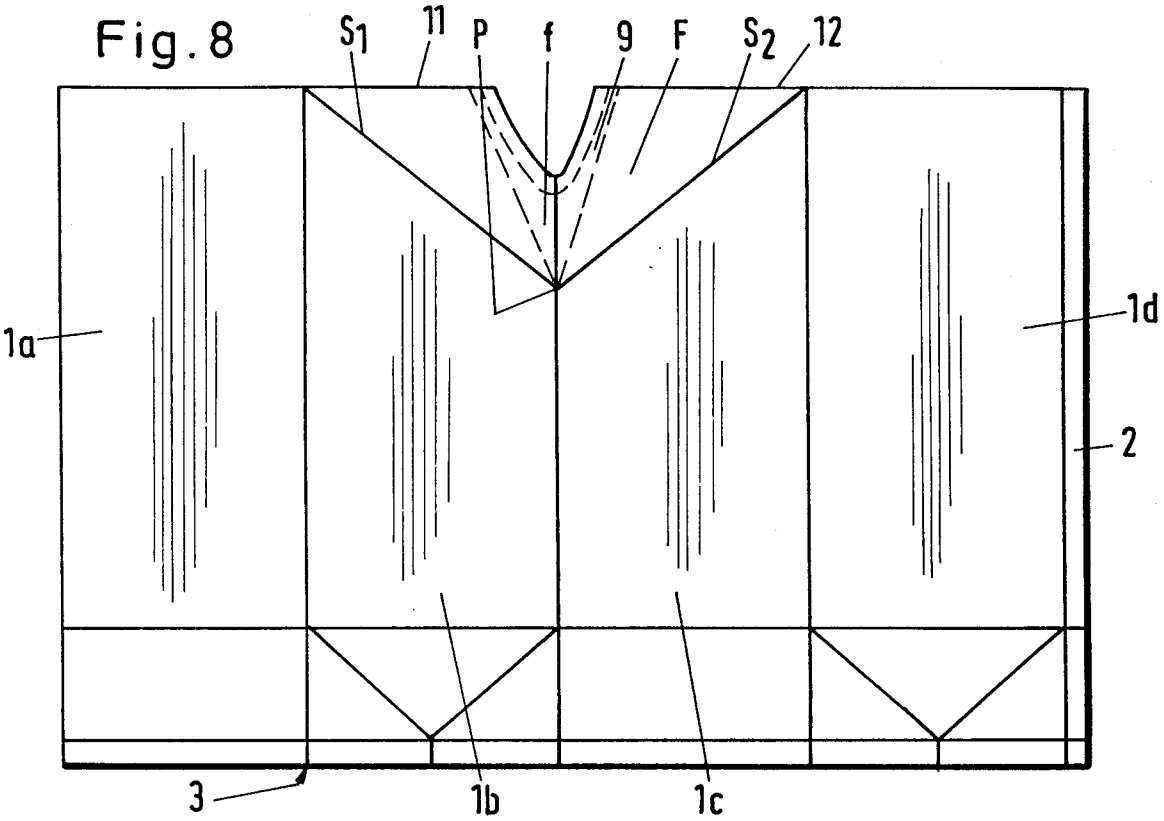
FIG. 8 is a blank cut from the coated cardboard strip and intended for forming the tube and bottom of a package of the type described.

The completed package for liquids shown in FIGS. 1 to 4 consists of a tube generally designated 1 which forms the four side walls designated particularly 1*a*, 1*b*, 1*c* and 1*d* in FIG. 8. It can be seen that only the two side walls 1*a* and 1*d* are rectangular, while the side walls 1*b* and 1*c* are trapezoidal.

The four side walls 1*a* to 1*d* are formed into a tube 1 by means of longitudinal seam 2.

The bottom generally designated 3 is formed in a per se known manner by those areas of walls 1*a*–1*d* which are shown at the bottom of the blank in FIG. 8.

More important and interesting for the explanation of the invention is the area of the cover 4. In the front portion, the cover 4 comprises the pouring device 5 while at the back it is provided with the handle 6. It can be seen that the handle 6 is disposed completely within the cuboid external contours of the package. It is for practical purposes disposed in a tetrahedral space between the diagonal D of the cover 4 and the upper cut-off region of the rear longitudinal edge 7 above the lower corner point P. Viewed from above in plan view of the cover 4 (FIG. 4), it is possible to see the overall dimensions a×a (FIG. 1) of the bottom 3. These are the lengths a of the sides which are also equal to the lengths of the sides of the square cover 4 shown in FIG. 4. In the case of the embodiment illustrated, this square is the tetragonal cross-sectional dimension of the package. This extends from the bottom 3 of the package to the cover 4 over the entire height H of the package.

The outer contours of the package are, however, also determined by the height H (FIG. 2). Since the handle 6 is disposed completely within the external contours of the package, even the upper part of the handle 6 does not project upwardly beyond the package as shown in FIG. 2. The outer contours of the package are constituted for practical purposes by the cuboid resulting from the product of the two lengths of the sides a and the height H, the volume thereof being equal to a×a×H.

The tetrahedral space in which the handle 6 is disposed has already been mentioned hereinabove and can best be explained in conjunction with FIGS. 1 to 3. Three sides of this tetrahedral space are formed by the cut-off extensions of the surface of the cover 4 rearwards beyond the diagonal D from the pourer device 5 and the two adjacent side walls 1*b* and 1*c*. It will be understood that these two side walls 1*b*, 1*c* or their extensions intersect at what is referred to as the rear end of the package in the rear longitudinal edge 7. Above the lower corner point P, this rear longitudinal edge 7 extends a little farther in the outer edge of the handle 6, but then moves away from the outer edge of the handle 6, as the edge bulges inwards and upwards towards the cover, as can best be seen from FIGS. 1 and 2. The two edges of the tetrahedral space not shown here then arise from the score lines of the side walls 1*b* and 1*c* with the extension of the cover surface 4 from the front rearwards beyond the diagonal D (not shown).

Figure 1:
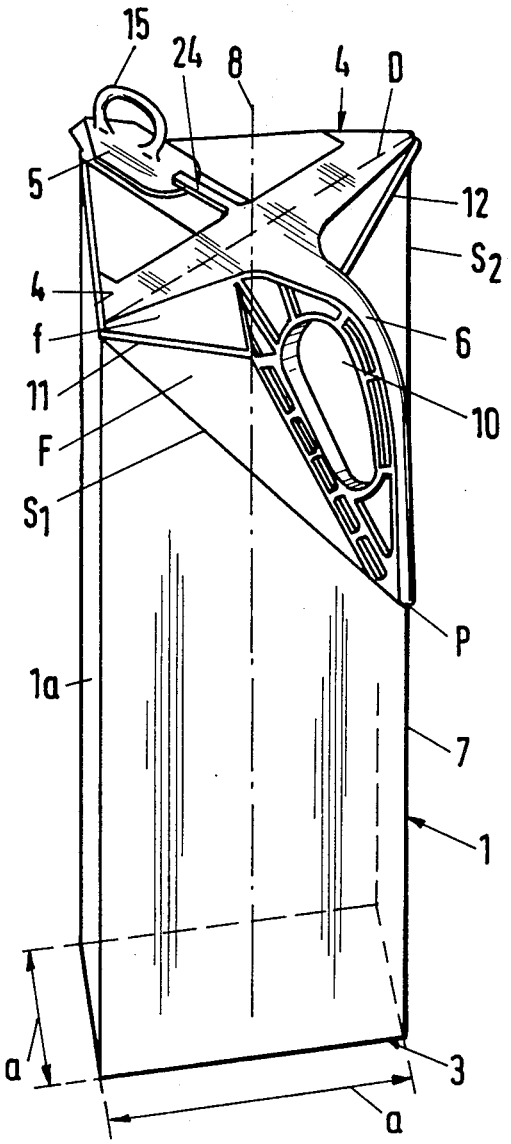
FIG. 1 is a perspective view of a liquids package incorporating the features according to the invention.

It is true that in FIGS. 1 to 6 shown here the handle is illustrated as being disposed in a tetrahedral space according to the preceding description. In this respect, the lower corner point P may be at a distance d (FIG. 2) from the cover 4 which is equal to one-third to one-half the height H of the package. On the other hand, the handle 6 need not emerge from a diagonal D as shown in FIG. 1 but can be disposed farther forwards or farther rearwards. In the case of another embodiment not shown, the space in which the handle 6 is within the outer contours of the package can also start from a line in the cover 4 which is located in front of the diagonal D, i. e., within the triangle formed by the two lateral edges a alongside the pouring tip and the diagonal D. Another embodiment could, however, have the handle in a space which is smaller than the spacer from the lower corner point P to the diagonal D. Certainly, the handle 6 should be disposed substantially in the vicinity of and above the center of gravity of the filled package.

In the embodiment illustrated, of the tetrahedral space the illustration shows only that face which extends through the diagonal D of the cover 4 and the lower corner point P and which thus forms score lines S1 and S2 with the lateral faces 1*b* and 1*c*. The sides S1, S2 and D form an equilateral triangle. In this triangular tetrahedral face F, starting from the bottom corner point P and extending in the direction of the longitudinal central axis 8 through the tube to the cover 4 is a double-wall base strip 9 indicated in FIG. 2 by a broken line shown parallel with and at a slight distance from the line S1. This broken line is the top edge of this double-walled base strip 9 which lies comletely in the handle 6 and which does not protrude into the gripping aperture 10. The bottom web of the handle 6 between gripping aperture 10 and tetrahedral face F is particularly favorably located on this doubled-walled base strip 9. Cover 4 with handle 6 can, for example, during manufacture of the package, be welded or injection molded on the base strip 9 upon closure of the top end of the tube 1.

If we examine FIGS. 1 to 4 and the blank shown in FIG. 8 more closely, then it becomes evident that the outer contours of the handle 6, on the package side, i.e. at the bottom, do not lie completely flush with the tetrahedral face F which, like the tube 1, consists of plastics coated cardboard material. Instead, the tetrahedral face F is cut off on lines 11 and 12 so that a partial triangular face f results which, in the embodiment illustrated, consists of synthetic plastics material with no carrier material, and is injection molded together with the cover 4 and handle 6 on the edges 11 and 12 of the coated cardboard.

Since the double-walled base strip 9 consists of the coated cardboard material, this does indeed extend from the lower corner point P inwards and upwards toward the cover 4, but does not reach the cover 4. Instead, the material ends before the cover, at the point of intersection of the two lines 11 and 12, so that it is shorter than the height h of the tetrahedral face F to the diagonal D (shown only with the other embodiment illustrated in FIG. 7). Consequently, only a part of the tetrahedral face F consists of coated cardboard, namely, that part which is formed by the lateral edges S1, S2, 11 and 12. The other face f which lies even outside the plane of the tetrahedral face F consists only of synthetic plastics with no cardboard.

Figure 7:
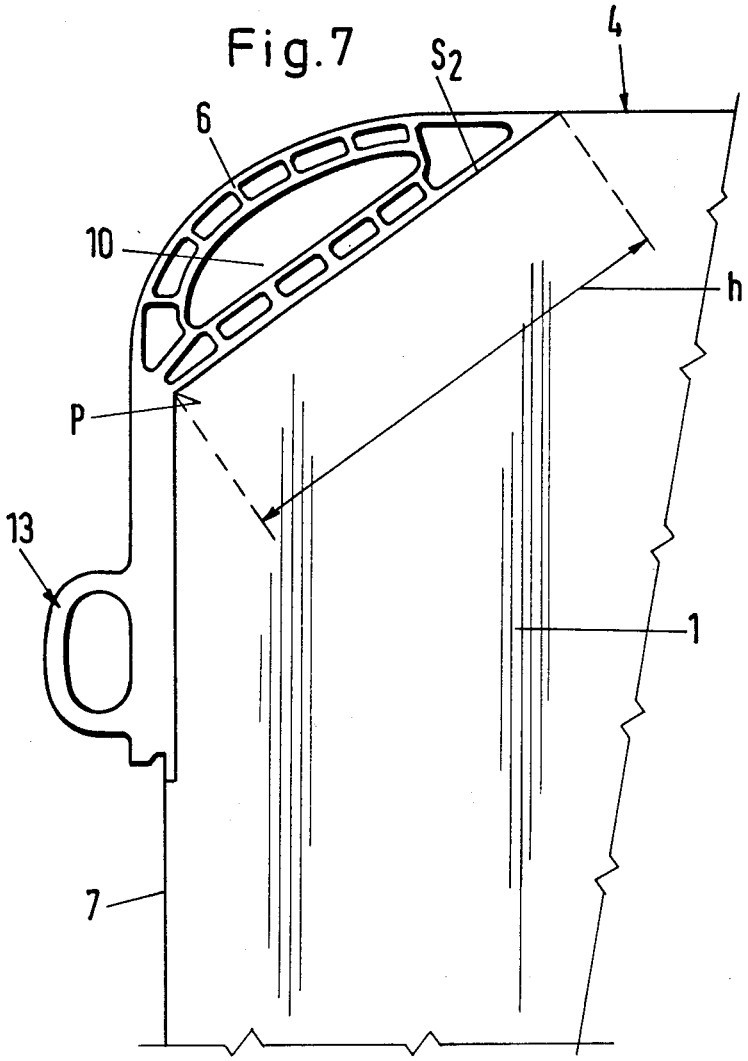
FIG. 7 is a broken-away side view of a handle with a lifting handle according to a different embodiment.

FIG. 7 shows another embodiment of the invention. In the region of the lower corner point P, and in the case of a two-liter liquids package, at a short distance of 2 to 4 cm below it, there is a lifting handle 13, preferably integrally molded on the rear longitudinal edge 7 to be in one piece with the handle 6. The first time the package is opened the end user can, for instance, insert one to three fingers into the gripping aperture 10 of the handle 6 in order to lift the package to shake out its contents, then engage another finger into the handle 13 in order to control the tilting movement more accurately.

Figure 5:
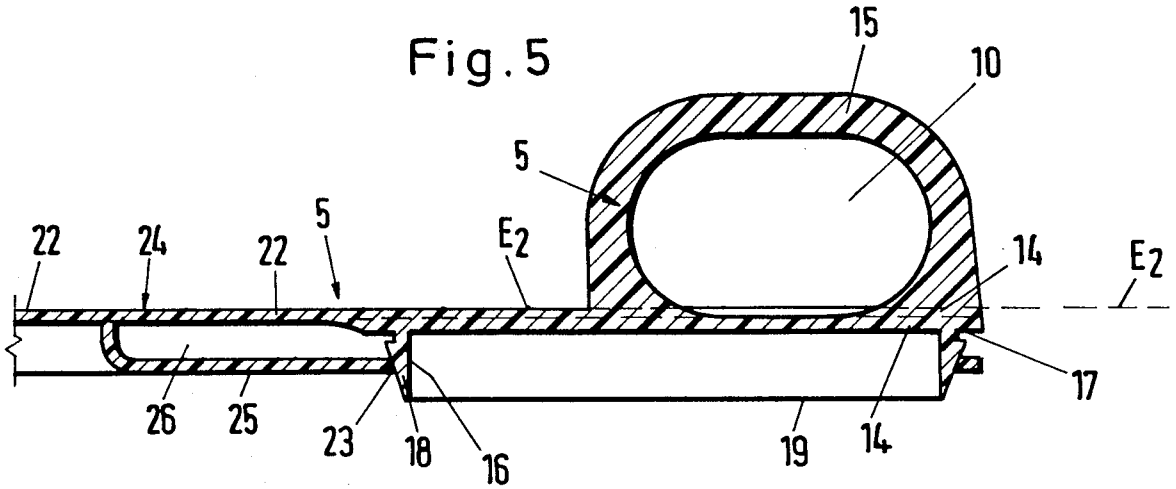
FIG. 5 is a broken-away sectional view of the pourer device substantially on the line V—V in FIG. 4.
Figure 6:
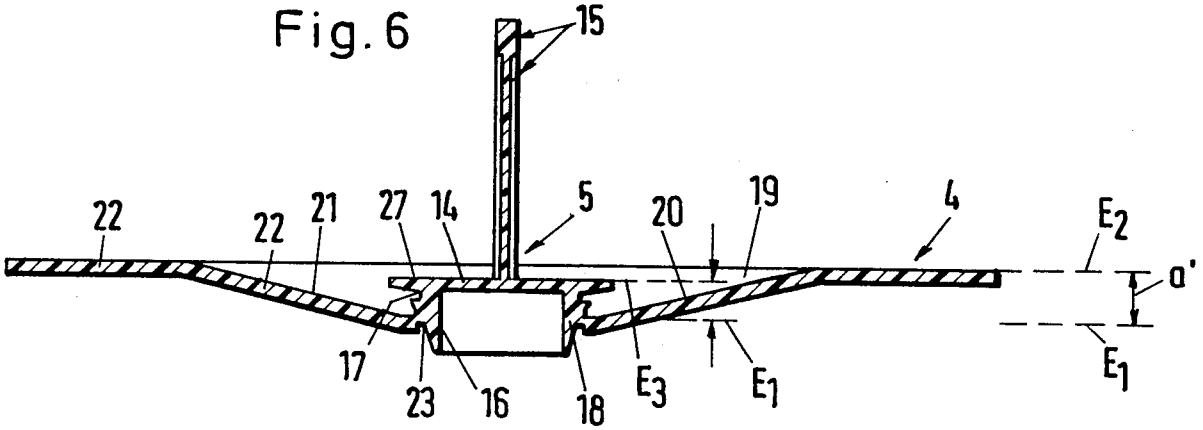
FIG. 6 is a likewise diagrammatic broken-away and similar view to that in FIG. 5, but at a right angle thereto, substantially on the line VI—VI in FIG. 4.

The pourer device shown in greater detail in FIGS. 5 and 6 and generally designated 5 consists of a cover 14 of elongated form on the top of which there is an injection molded handle 15. On the underside opposite the handle 15, towards the interior of the package, there is molded onto the cover 14 an encircling flange 16 which has a back taper 17 engaging around a wedge-shaped shoulder 18. The bottom edge 19 of this shoulder 18 projects into the interior of the package and the entire pouring device (apart from the handle 15 which is folded over into the transit position) is disposed in a depression designated 19 formed by ramp-like oblique surfaces 20 and 21 (all of synthetic plastics material). These ramp-like oblique faces then merge into the general upper walls of the cover 4 designated 22 in FIG. 6.

Provided at location 23 (FIGS. 5 and 6) is a line of weakness around the should 16 and along which, the first time the package is opened, the cover 14 can be torn out of the cover surface 21. To the rear, towards, the handle 6, the covering 14 is articulated like a hinge through a strip 24. This extends into the wall 25 (FIG. 5), forming a space 26 which is open to both sides underneath the strip 24.

It can be seen from FIG. 6 that, due to the line of weakness 23, there is defined substantially halfway up the shoulder 16 a first plane E1 located a distance a' (FIG. 6) from the main plane E2 which is formed by the surface of the cover 4 or its walls 22. The surface 27 of the tear-off closure cap 14 of the pourer device 15 lies in a third plane E3 which is between the lower plane E1 and the upper plane E2. If, after injection molding of the cover on the tube 1, the handle 15 is moved over into the horizontal, then the space between the third face E3 and the upper plane E2 is sufficient to accommodate the entire wall thickness of the handle 15. In this flipped-over transit position in which, for example, the cover 4 can be formed, there are therefore all of the parts which are formed together with the cover and they are all in one piece within the outside contours of the overall package.

In the case of the embodiment shown in the drawings, only one double-walled base strip 9 is located in the region of the handle, its upper edge being indicated by the broken line in FIG. 2 while its bottom edge lies in a projection of the line S1. However, the handle 6 may have only its bottom quarter, its bottom third or its bottom half consisting of the coated cardboard while the rest of the handle 6 consists of synthetic plastics material without a carrier material. On the other hand, it is also possible for the middle part to consist of a combination of synthetic plastics material and coated cardboard while the bottom part consists only of the normally coated cardboard.

In the case of the embodiment shown in FIG. 7, a synthetic plastics strip should furthermore be constructed not only on the outside, but also on the inside of the package and extend from the top downwards substantially to the region of the lifting handle 13. In the case of a further preferred embodiment, this synthetic plastics strip may also be molded on beyond the region or the height of the lifting handle 13 and extend downwardly as far as the bottom.

While the forms of apparatus herein described constitute preferred embodiments of this invention, it is to be understood that the invention is not limited to these precise forms of apparatus, and that changes may be made therein without departing from the scope of the invention which is defined in the appended claims.

What is claimed is:

1. A package for flowable contents, comprising:

a tube formed of carrier material coated at least on one side with thermoplastics synthetic material and having at least one longitudinal seam;

a cover formed of thermoplastics synthetic material with no carrier material, injection molded onto one end of said tube and defining a pourer device;

a tetragonal bottom located at an opposite end of said tube and constructed from a folded over portion of said tube;

a handle connected to said cover and mounted laterally on said tube below said cover;

said package defining a quadrilateral outer contour, the outside dimensions of said bottom being equal to the tetragonal outer cross-sectional dimensions of said package along said tube from said bottom to said cover; and said handle and said cover being integrally injection molded onto said tube within the quadrilateral outer contours of said package.

2. The package of claim 1, wherein said handle is disposed within a tetrahedral space, one edge of said tetrahedral space being defined by a diagonal of said cover.

3. The package of claim 2, wherein said tetrahedral face which passes through said diagonal of said cover intersects a rear longitudinal edge of said tube at a lower corner point located a distance from said cover which is equal to between one-third to one-half the height of said package.

4. The package of claim 1, wherein a doubled-walled base strip of coated cardboard is disposed from said lower corner point and extends toward a longitudinal central axis through said tube to said cover.

5. The package of claim 4, wherein said double-walled base strip is shorter than the height of said triangular tetrahedral surface on said diagonal and wherein only a part of said tetrahedral surface consists of coated cardboard.

6. The package of claim 3, further comprising a lifting handle located in the region of said lower corner point.

7. The package of claim 1, wherein a top edge of said handle is rounded from a rear longitudinal edge of said tube upwardly to said cover and forwardly to said pourer device, said top edge merging into at least one part of the surface of said cover.

* * * * *